US010582789B2

(12) United States Patent
Klugh et al.

(10) Patent No.: US 10,582,789 B2
(45) Date of Patent: Mar. 10, 2020

(54) VESSEL HOLDER DEVICE STOWABLE WITHIN A SUITCASE

(71) Applicants: Jason T. Klugh, Charlotte, NC (US); Thomas M. Ricciuto, Aiken, SC (US)

(72) Inventors: Jason T. Klugh, Charlotte, NC (US); Thomas M. Ricciuto, Aiken, SC (US)

(73) Assignee: Work Hard, Play Harder LLC, Charlotte, NC (US)

( * ) Notice: Subject to any disclaimer, the term of this patent is extended or adjusted under 35 U.S.C. 154(b) by 0 days.

(21) Appl. No.: 15/920,814

(22) Filed: Mar. 14, 2018

(65) Prior Publication Data

US 2018/0271310 A1 Sep. 27, 2018

Related U.S. Application Data

(60) Provisional application No. 62/474,115, filed on Mar. 21, 2017.

(51) Int. Cl.

| | |
|---|---|
| ***A45C 13/28*** | (2006.01) |
| ***A47G 23/02*** | (2006.01) |
| ***A45C 13/26*** | (2006.01) |

(52) U.S. Cl.

CPC ..... *A47G 23/0225* (2013.01); *A45C 13/262* (2013.01); *A45C 13/28* (2013.01); *A45C 2013/267* (2013.01); *A45C 2200/20* (2013.01); *A45F 2200/055* (2013.01); *A45F 2200/0516* (2013.01); *A45F 2200/0583* (2013.01)

(58) Field of Classification Search

CPC ... A45C 13/28; A45C 2200/20; A45C 13/262; A47G 23/0225

USPC ..... 190/102

See application file for complete search history.

(56) References Cited

U.S. PATENT DOCUMENTS

| | | | | |
|---|---|---|---|---|
| 3,051,428 | A | 8/1962 | Schult | |
| 4,819,843 | A | 4/1989 | Nakayama | |
| 5,129,610 | A | 7/1992 | Campbell | |
| 5,664,718 | A | 9/1997 | Vine | |
| 6,609,599 | B1 * | 8/2003 | Chang | A45C 13/02 16/113.1 |
| 8,827,216 | B2 | 9/2014 | Brown et al. | |
| 9,498,055 | B2 * | 11/2016 | Distefano | A47B 5/04 |
| 9,700,164 | B2 | 7/2017 | Klugh et al. | |
| 2003/0197104 | A1 | 10/2003 | Heybl et al. | |
| 2006/0022106 | A1 | 2/2006 | Mackin | |
| 2006/0037825 | A1 * | 2/2006 | Dayton | A45C 13/28 190/110 |
| 2010/0051633 | A1 | 3/2010 | Porte et al. | |
| 2014/0299428 | A1 * | 10/2014 | Gadbois | A45C 9/00 190/11 |

(Continued)

*Primary Examiner* — Sue A Weaver

(74) *Attorney, Agent, or Firm* — Clements Bernard Walker; Christopher L. Bernard

(57) ABSTRACT

A vessel holder device for use with a rolling case comprising an extensible handle, the vessel holder device comprising: a body structure; an attachment structure coupled to the body structure configured to couple the body structure to the extensible handle; a vessel holder assembly one or more of pivotably and rotatably coupled to the body structure; and an enclosure disposed with an interior portion of the rolling case that is configured to receive the body structure and the attachment structure when the extensible handle is retracted towards and/or into the rolling case.

10 Claims, 9 Drawing Sheets

(56) References Cited

U.S. PATENT DOCUMENTS

| | | | | |
|---|---|---|---|---|
| 2016/0022032 | A1* | 1/2016 | Simon | A45C 13/28<br>108/42 |
| 2016/0081505 | A1* | 3/2016 | Berg | A47G 23/0225<br>224/401 |

* cited by examiner

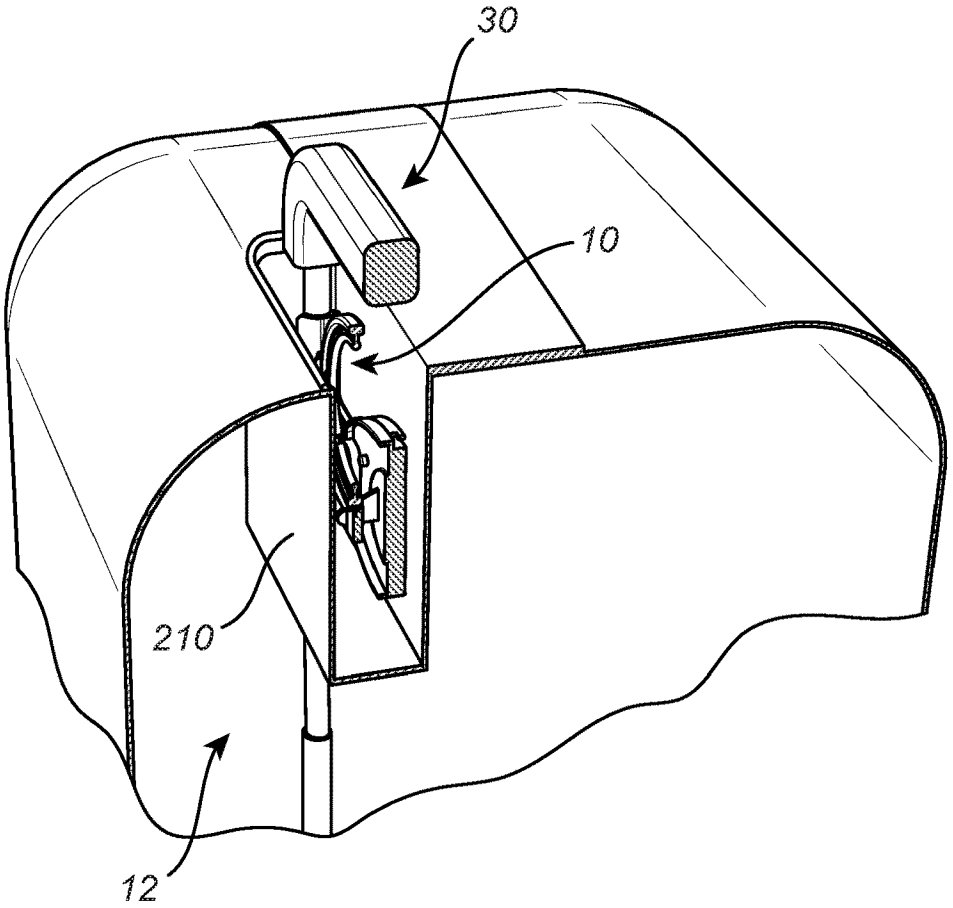
Fig. 9
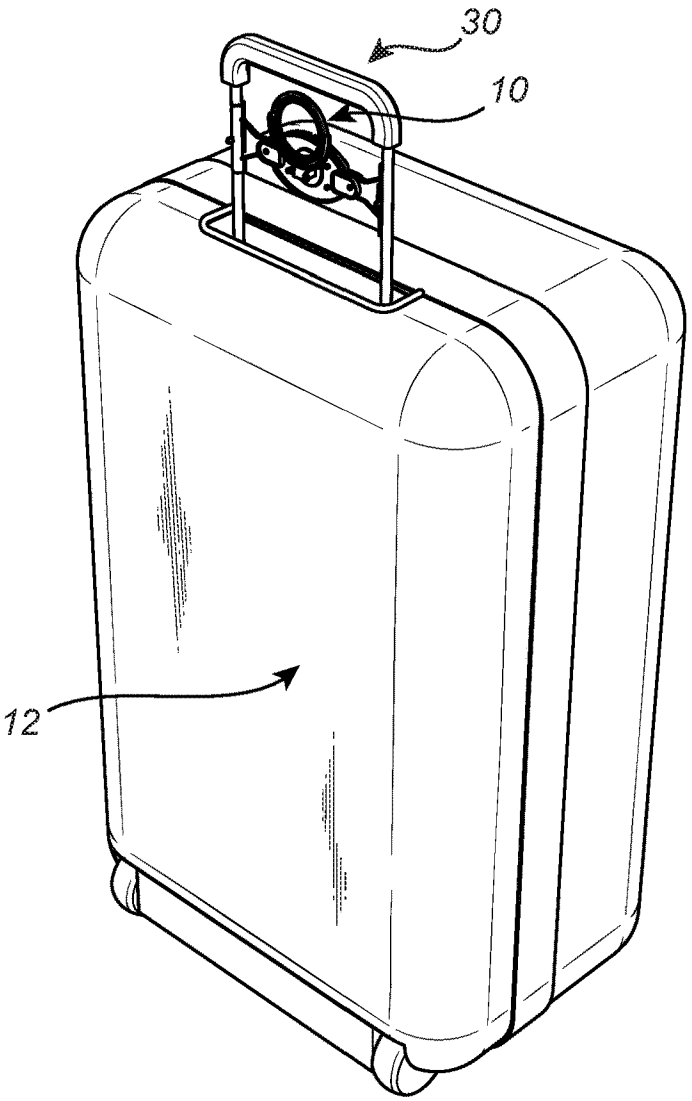

VESSEL HOLDER DEVICE STOWABLE WITHIN A SUITCASE

CROSS-REFERENCE TO RELATED APPLICATION

The present patent application/patent claims the benefit of priority of U.S. Provisional Patent Application No. 62/474,115, filed on Mar. 21, 2017, and entitled "STOWABLE VESSEL HOLDER DEVICE ATTACHABLE TO A SUITCASE," the contents of which are incorporated in full by reference herein.

FIELD OF THE INVENTION

The present invention relates generally to a vessel holder device and the travel industry. More particularly, the present invention relates to a cup or bottle holder device that is attachable to and stowable within a suitcase.

BACKGROUND OF THE INVENTION

A person traveling for business or pleasure commonly brings a suitcase for holding business or personal effects. A typical suitcase includes a storage compartment, an extensible handle, and wheels to aid in transport by allowing the suitcase to be rolled instead of being carried. Nonetheless, moving a suitcase occupies one hand of the person. It is commonplace for the person to also be carrying a purse, computer bag, or other article thereby further occupying the hands of the person.

Oftentimes, the person desires to carry a drink, such as coffee, while traversing an airport or hotel lobby, or walking to the parking lot, or picking up a taxi. However, carrying a drink can be difficult while trying to walk with a suitcase and possibly one or more other bags. Another difficulty occurs when the person's hands are needed, for example to grab a ticket or ID or use a telephone, and there is no nearby suitable place to set the drink. Resultantly, the drink may spill while attempting to juggle too many items or tip over if set upon the suitcase or accidentally kicked if placed on the floor.

In view of the aforementioned drawbacks encountered with the existing practice of not having a suitable place to set a drink while moving a suitcase, there exists a need for a device that addresses this issue. More particularly, there exists a need for a vessel holder device attachable to a suitcase that is both easy to install and use. There exists a further need for a vessel holder device that is attachable to a suitcase that retains a filled vessel when the suitcase is upright and also while rolling the suitcase. Finally, there exists a need for a vessel holder device that is readily stowable within the suitcase with the extensible handle without having to be removed and subsequently reattached.

Other aspects, objects, features, and advantages of the present invention will be made apparent or will be readily understood and appreciated by those skilled in the relevant art as exemplary embodiments of the invention are described in greater detail hereinafter and shown in the accompanying drawing figures. It is intended that all such aspects, objects, features, and advantages of the present invention envisioned by this disclosure of exemplary embodiments are within the broad scope of the appended claims. The above and other aspects, objects, features, and advantages may be accomplished by any of the exemplary embodiments of the present invention described herein and illustrated in the accompanying drawing figures. However, it should be appreciated that the drawing figures are for illustrative purposes only, and that many modifications, changes, revisions, and substitutions may be made to any of the exemplary embodiments without departing from the broadest reasonable interpretation of the appended claims.

BRIEF SUMMARY OF THE INVENTION

In a preferred embodiment, the present invention provides a vessel holder device that is attachable to a suitcase for holding a cup containing a drink, such as coffee, tea, or water, or a soda can, water bottle, or the like, when the suitcase is upright and also while rolling the suitcase at a tilted angle. The vessel holder device includes a handle attachment adapted for releasable attachment to a suitcase handle assembly, a container attached to the handle attachment portion, and a vessel holder attached to the container.

In one specific exemplary embodiment, the present invention provides a vessel holder device for use with a rolling case comprising an extensible handle, the vessel holder device comprising: a body structure; an attachment structure coupled to each side of the body structure configured to couple the body structure to the extensible handle; and a vessel holder assembly one or more of pivotably and rotatably coupled to the body structure. Optionally, each attachment structure is pivotable with respect to the body structure. Optionally, each attachment structure comprises one or more of a cradle and a clamp configured to couple the attachment structure to the extensible handle. The vessel holder assembly is configured to hold a vessel disposed therein in a substantially horizontal orientation when a longitudinal axis of the rolling case is in a range of 45 degrees to 90 degrees. The vessel holder device further comprises an enclosure disposed with an interior portion of the rolling case that is configured to receive the body structure and the attachment structure when the extensible handle is retracted towards and/or into the rolling case.

In another specific exemplary embodiment, the present invention provides a vessel holder device for use with a rolling case comprising an extensible handle, the vessel holder device comprising: a body structure; an attachment structure coupled to the body structure configured to couple the body structure to the extensible handle; a vessel holder assembly one or more of pivotably and rotatably coupled to the body structure; and an enclosure disposed with an interior portion of the rolling case that is configured to receive the body structure and the attachment structure when the extensible handle is retracted towards and/or into the rolling case. Optionally, the attachment structure is pivotable with respect to the body structure. Optionally, the attachment structure comprises one or more cradles and clamps configured to couple the attachment structure to the extensible handle. The vessel holder assembly is configured to hold a vessel disposed therein in a substantially horizontal orientation when a longitudinal axis of the rolling case is in a range of 45 degrees to 90 degrees.

In a further specific exemplary embodiment, the present invention provides a rolling case, comprising: a case body; an extensible handle; and a vessel holder device, comprising: a body structure; an attachment structure coupled to the body structure configured to couple the body structure to the extensible handle; a vessel holder assembly one or more of pivotably and rotatably coupled to the body structure; and an enclosure disposed with an interior portion of the case body that is configured to receive the body structure and the attachment structure when the extensible handle is retracted towards and/or into the case body. Optionally, the attachment structure is pivotable with respect to the body structure. Optionally, the attachment structure comprises one or more cradles and clamps configured to couple the attachment structure to the extensible handle. The vessel holder assembly is configured to hold a vessel disposed therein in a substantially horizontal orientation when a longitudinal axis of the rolling case is in a range of 45 degrees to 90 degrees.

BRIEF DESCRIPTION OF THE DRAWINGS

The aforementioned objects, features, and attendant advantages of the present invention will be more fully understood and appreciated when considered in conjunction with the accompanying drawings, in which like reference characters designate the same or similar parts throughout the several views.

FIG. 9 is a series of perspective views of a further exemplary stowable embodiment of the vessel holder device of the present invention.

DETAILED DESCRIPTION OF THE INVENTION

Figure 1:
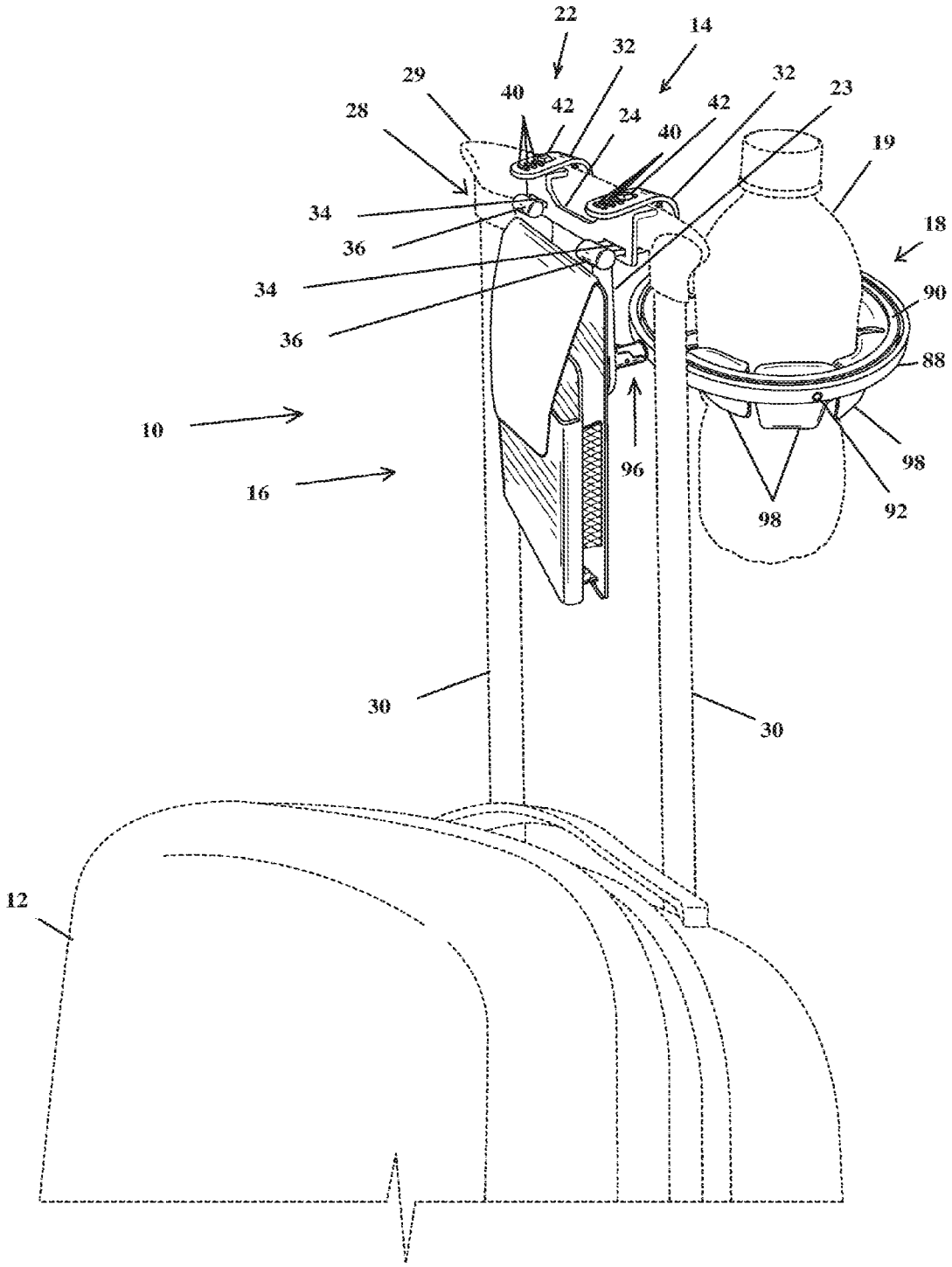
FIG. 1 is a front perspective view showing a vessel holder device attached to a handle of a suitcase according to an exemplary embodiment of the present invention.

FIGS. 1-7 illustrate a vessel holder device, indicated generally by reference character 10, attachable to a suitcase 12 according to exemplary embodiments of the present invention. The vessel holder device 10 is used to retain a cup containing a drink, such as coffee, tea, or water, or a can, or a bottle, or the like (individually and collectively the "vessel"), when the suitcase 12 is upright and also while rolling the suitcase 12 at a tilted angle. Terms of orientation are in reference to the vessel holder device 10 as if being in use, attached to a suitcase 12.

The vessel holder device 10 includes a handle attachment 14 for attaching the device 10 to the suitcase 12, a container 16 attached to the handle attachment 14 for carrying personal items such as a ticket, passport, cellular phone, pen, etc., and a vessel holder 18 attached to the handle attachment 14 for holding a vessel 19 containing liquid or food.

In a preferred embodiment, the handle attachment 14 includes a body 20 and an attachment portion 22. Referring specifically to FIGS. 1-5 and 7, the body 20 has an elongate first portion 23 to which the container 16 and vessel holder 18 are attached and a bifurcated second portion 24 for providing structure for attachment to the suitcase 12. The first portion 23 includes a shoulder 25 and the second portion 24 includes lips 26 angled and/or curvlinearly extending from the second portion 24, which provide engagement structures adjacent to and at least partially encircling a portion of a suitcase handle 28 for assisting in maintaining the body 20 generally in parallel orientation with extensible legs 30 of the suitcase 12. For example, the second portion 24 may be adjacent to and engage a front side and a top of a handle member 29 of the suitcase handle 28, whereas the shoulder 25 of the first portion 23 may be adjacent to and engage a bottom of the handle member 28.

The attachment portion 22 includes at least one flexible strap 32 (two straps 32 are illustrated) for attaching the device 10 to the suitcase 12. Each flexible strap 32 attaches at an end to the body 20, for example by positioning the strap 32 through an aperture 34 in the second portion 24 and having an enlarged end 36 to maintain the strap 32 from fully passing through the aperture 34, and has a free end portion 38 with a plurality apertures 40 for receiving a hook 42 protruding from the second portion 24. The strap 32 in combination with the second portion 24 encircles the suitcase handle 28 to attach the device 10 to the suitcase 12. Length adjustment of the strap 32 to accommodate different diameter suitcase handles is achieved by securing the hook 42 through a desired aperture 40. The handle attachment 14 may be rotated relative to the container 16, for example by 90 degrees, such that the device 10 may be attached to either the handle member 29 or extensible leg 30 of the suitcase handle 28. Upon securing the device 10 to the suitcase handle 28, the handle attachment 14 is secured thereto such that the handle attachment 14 does not or only minimally rotates about suitcase handle 28 when the device 10 is in use. The attachment portion 22 of the handle attachment 14 maintains the vessel holder device 10 securely in place on the suitcase handle 28 while allowing for the vessel holder device 10 to be easily and quickly attached to and removed from the suitcase handle 28.

In a preferred embodiment, the body 20 is rigid such that it exhibits little or no flexibility and the attachment portion 22 is flexible. For example and not to be construed as limiting, the body 20 may be made of a hard plastic or rubber whereas the attachment portion 22 may be made of a flexible rubber, plastic, or fabric, so that it may be wrapped around the suitcase handle 28. In an embodiment, the body 20 may be configured generally in a T-shaped or any other suitable shape. In an embodiment, the attachment portion 22 may be alternatively configured as a strap 32 having hook and loop material, snaps or the like for securing the strap 32 around the suitcase handle 28.

Figure 4:
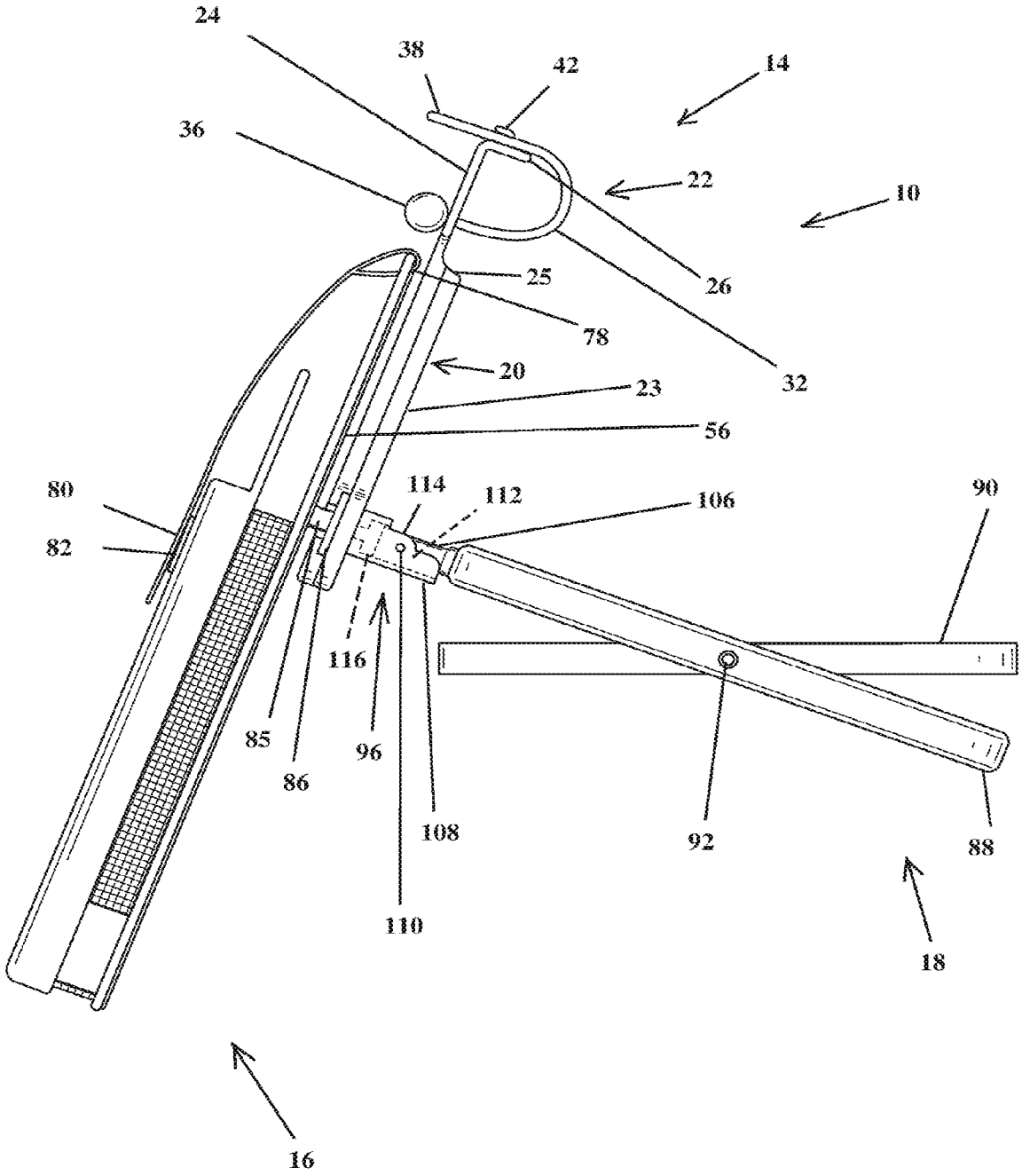
FIG. 4 is a left side view of the vessel holder device of FIG. 1.
Figure 5:
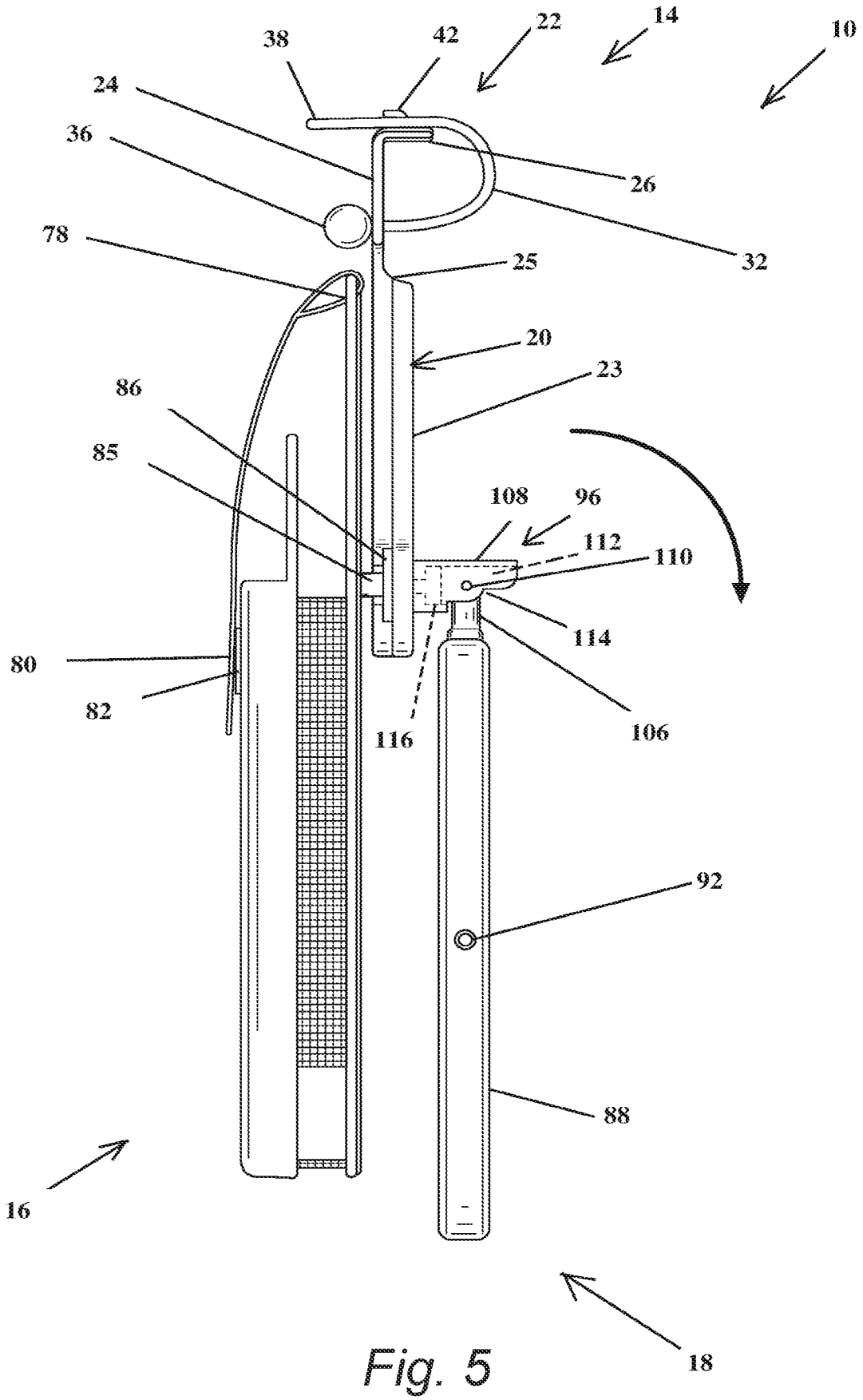
FIG. 5 is a left side view of the vessel holder device of FIG. 1 showing a vessel holder in a stowed position.
Figure 6:
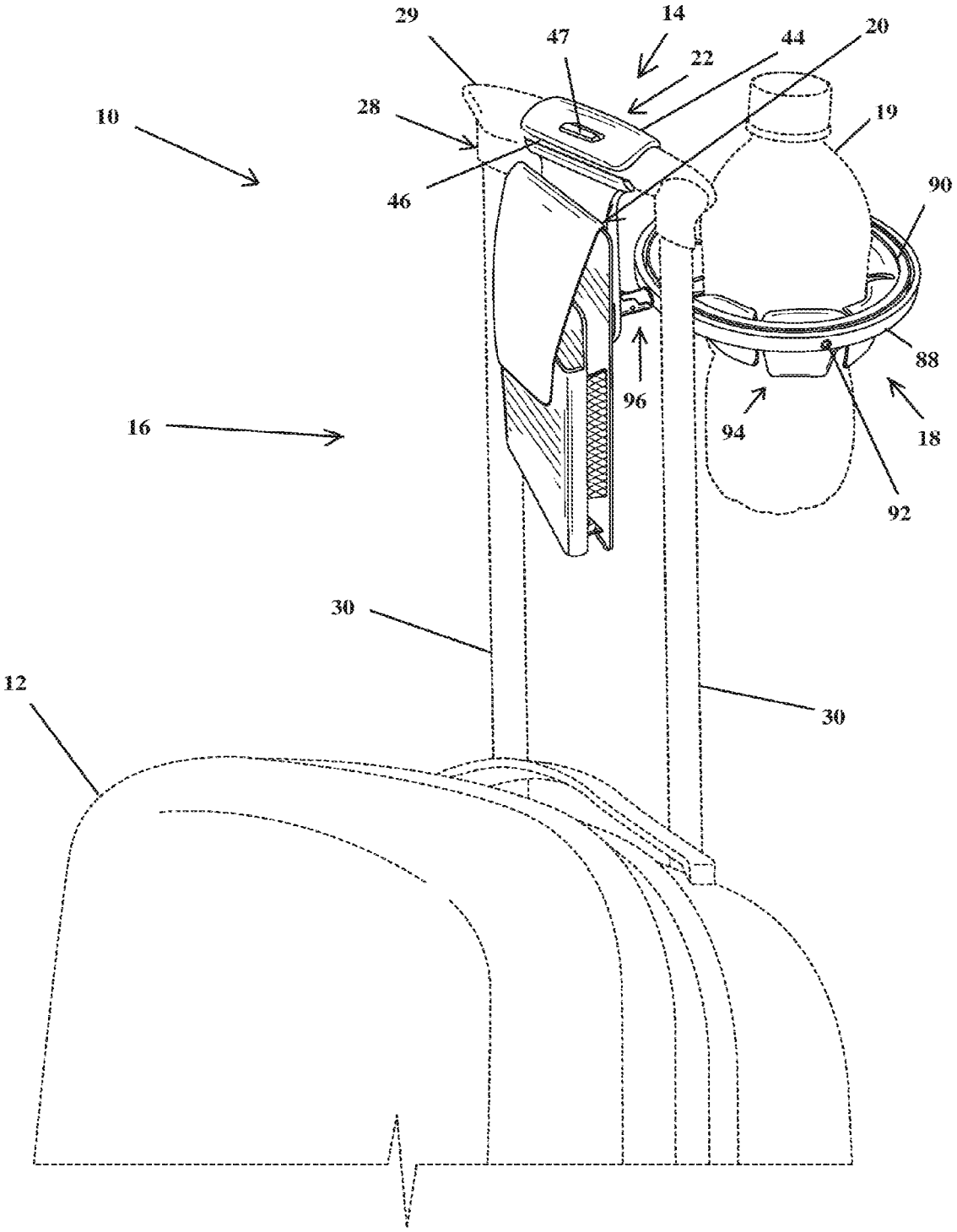
FIG. 6 is an embodiment of the vessel holder device similar to that of FIG. 1, except that the device is attached to the suitcase handle by a sleeve.

Referring specifically to FIG. 6, in an embodiment of a vessel holder device 10 having the same configuration and function as that described in referenced to FIGS. 1-5, except that the second portion 24 of the handle attachment 14 is configured as a hollow sleeve 44 having a slit 46. The sleeve 44 is formed of rubber, plastic or other suitable material having an elastic characteristic such that the handle attachment 14 can be securely positioned around a portion of the suitcase handle 28. In particular, the sleeve 44 is pressed onto the suitcase handle 28, causing the slit 46 to further open until a segment of the suitcase handle 28 is forced through the slit 46 and resides wholly or at least partially within the hollow interior of the sleeve 44. The sleeve 44 friction fits on the suitcase handle 28 such that the suitcase handle 28 does not or only minimally rotates about the suitcase handle 28 when the device 10 is in use. An aperture 47 may be provided in the sleeve 44 to allow access to suitcase handle release button for retracting and lengthening the suitcase handle 28. The sleeve 44 maintains the vessel holder device 10 securely in place on the suitcase handle 28 while allowing for the vessel holder device 10 to be easily and quickly attached to and removed from the suitcase handle 28.

Figure 2:
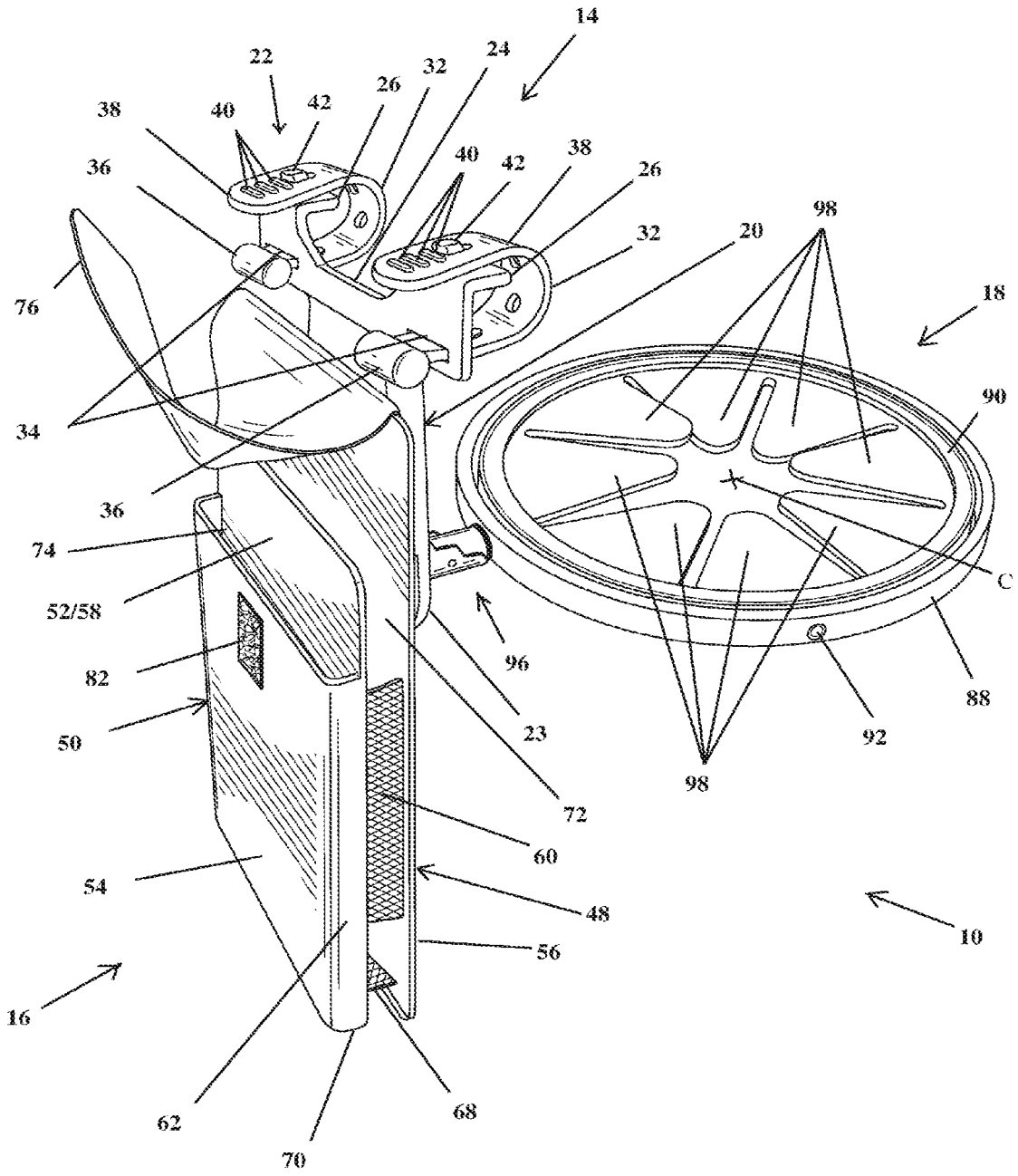
FIG. 2 is a front perspective view showing the vessel holder device of FIG. 1.
Figure 3:
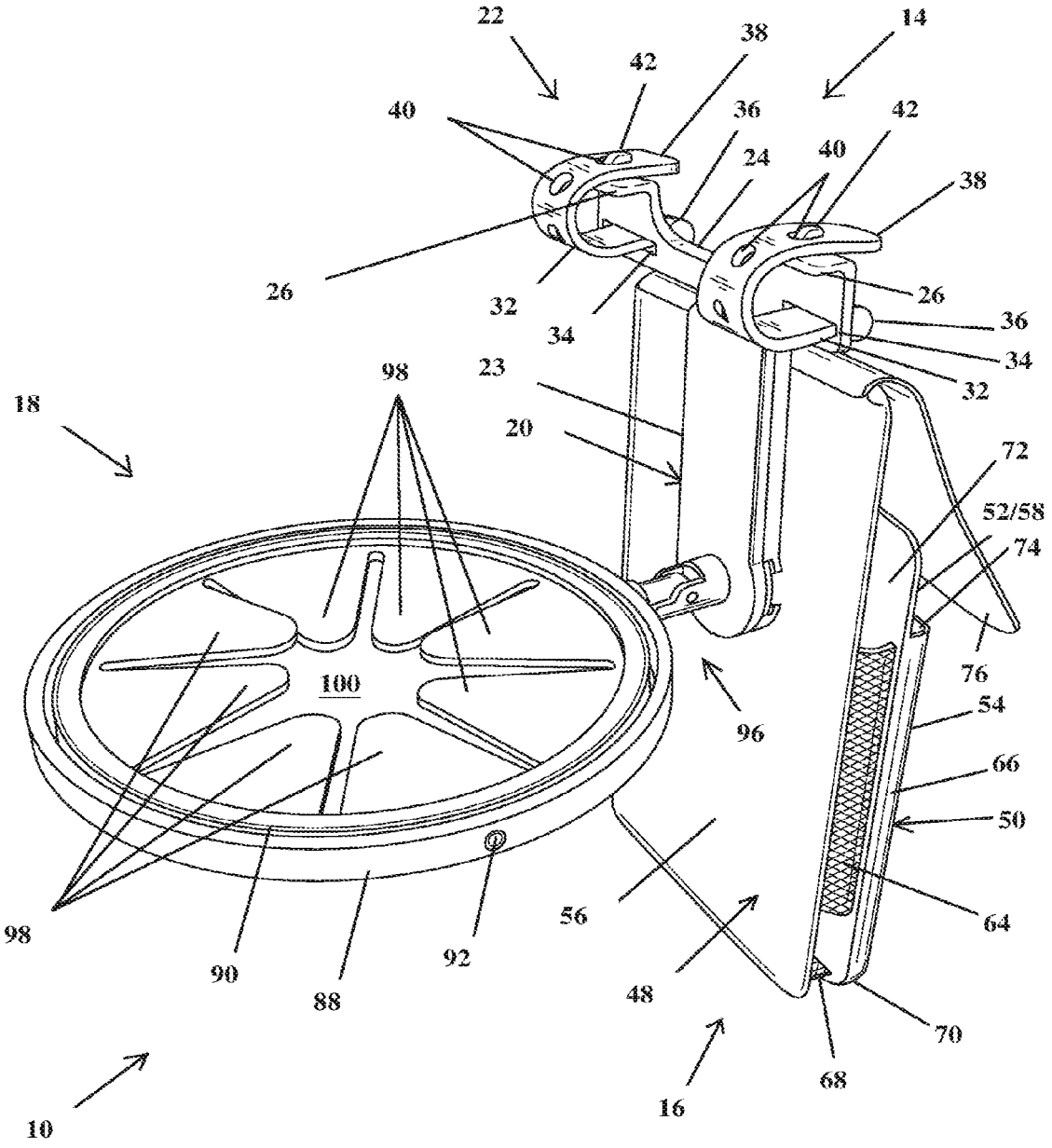
FIG. 3 is a rear perspective view showing the vessel holder device of FIG. 1.

Referring specifically to FIGS. 2 and 3, the container 16 includes at least one pocket which defines a chamber for the storage of items, such as pens, passport, driver's license, cellular phone, etc. (two pockets 48, 50 are shown). Each pocket 48, 50 includes a front major wall 52, 54, a rear major wall 56, 58, a first side wall 60, 62, a second side wall 64, 66, a bottom wall 68, 70, and an open top 72, 74 for allowing items to by placed into and retrieved from the pockets 48, 50. Where there are two or more pockets 48, 50, adjacent pockets 48, 50 share a common major wall. For example, the front major wall 56 of the first pocket 48 serves as the rear major wall 54 of the second pocket 50. Each of the walls 56, 58, 60, 62, 64, 66, 68, 70 may be rigid, for example made of a hard plastic or rubber, to provide suitable structure for the device 10. Optionally, any or all of the walls 52, 54, 56, 60, 62, 64, 66, 68, 70 other than the first pocket rear wall 56 may be flexible and/or elastic to accommodate positioning of an item therein. For example, the side walls 60, 64 and bottom wall 68 of the first pocket 48 may be made of a flexible, elastic fabric that allows for the pocket 48 to expand when placing an item in the pocket 48.

Optionally, at least one flap 76 is provided to enclose the top 72 of the first pocket 48 and/or the top 74 of the second pocket 50. In the exemplary embodiment, the flap 76 is attached to the rear wall 56 of the first pocket 48 by looping a first end of the flap 76 through a slot 78 (FIGS. 4 and 5) in the rear wall 56 and securing by stitching, an adhesive, or other suitable means. The free end of the flap 76 has sufficient length to cover over the first and second tops 74, 76 of the pockets 48, 50. Complementary hook and loop material 80, 82 is provided in the free end of the flap 76 and front wall 54 to allow the flap 76 to be releasably secured closed. Preferably, the flap 76 is flexible and made of fabric.

The container 16 includes a shaft 84 with an enlarged head 86. The enlarged head 86 is received within a slot provided in the attachment portion 22 thereby attaching the container 16 to the attachment portion 22. Optionally, the shaft 84 may allow relative rotation between the container 16 and attachment portion 22 such that they may be rotated, for example, about 90 degrees of each other in order to optionally allow for the attachment portion 22 to be attached either the handle member 29 or extensible leg 30 of the suitcase 12 for securing the device 10 in position on the suitcase 12.

Referring specifically to FIGS. 1-7, the vessel holder 18 includes a first ring 88, a second ring 90 having a diameter less than that of the first ring 88 and being rotatably attached to the first ring 88 via a pair of pivots 92, a support structure such as a flange 94 (FIGS. 1-6) extending inwardly from the second ring 90, and a shaft 96 extending from the first ring 88 for attachment to the handle attachment 14. The second ring 90 is concentrically nested within and spaced from the first ring 88. In an exemplary embodiment, the second ring 90 has an inner diameter of about 2⅝ inches to 4⅝ inches and an outer diameter in the range of about 2⅝ inches to 4⅝ inches, whereas the first ring 88 has an inner diameter larger than the outer diameter of the second ring 90 for example by about ⅛ inch to ¼ inch. Although the first and second rings are preferably annual, they may be of other shapes and configurations. For example, the first ring 88 may be a semi-circle that terminates just past the pivots 92. The first and second rings 88, 90 are rigid, being made of plastic, rubber or other suitable material.

The flange 94 includes a plurality of inwardly directed triangularly shaped sections 98, although other shapes may be used, each having a terminal end spaced a distance, for example in a range of about % inch to % inch, more preferably about % inch to % inch, from a center point (C) of the second ring 90. As such, a starburst shaped opening 100 with central opening of about ⅛ inch to ¾ inches, more preferably about ½ inch to ½ inch, in diameter is provided at the center of the flange 94. The flange sections 92 are elastic such that they are bendable to accommodate a vessel 19 having a diameter greater than the diameter of the opening 100 but less than the inner diameter of the second ring 90, and also being able to collectively support the weight of the vessel 19 containing a liquid, for example any of a standard 8 fluid oz, 12 fluid oz and 16 fluid oz water bottle filled with water. Preferably, the flange 94 is capable of supporting a bottle having a diameter in the range of 2 inches to 2⅝ inches and having a weight in the range of 6 oz to 8 oz and more preferably in a range of 6 oz to 16 oz. Furthermore, the flange 94 is resilient such that it returns to its original shape after the vessel 19 is removed. The flange 94 is made of plastic, rubber, foam or other material capable holding the vessel 19.

Figure 7:
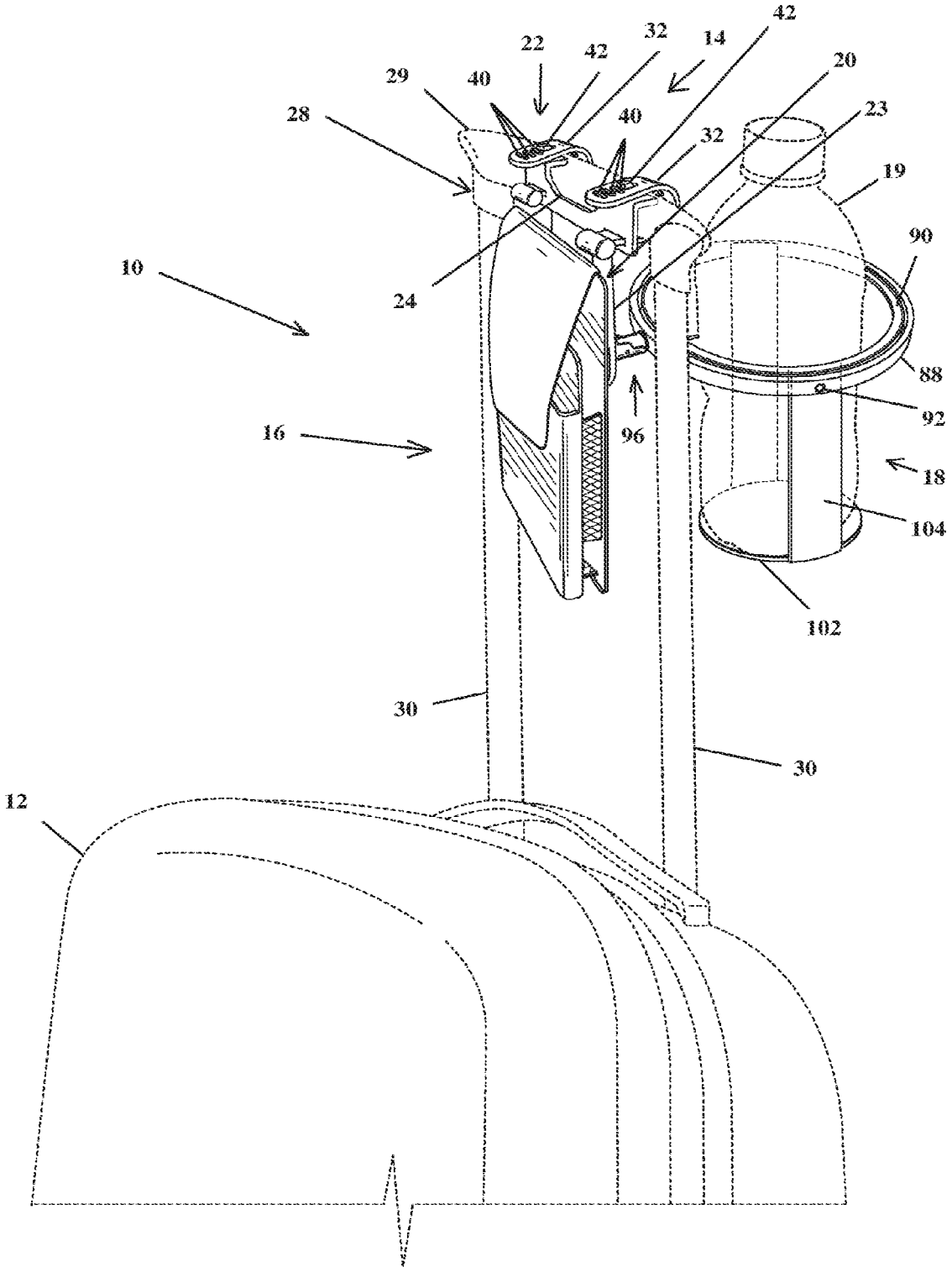
FIG. 7 is an embodiment of the vessel holder device similar to that of FIG. 1, but wherein the device further includes a support structure for holding a vessel.

Referring specifically to FIG. 7, other support structures may be used instead of or in conjunction with a flange 94 to hold the vessel 19. For example, a support structure may includes a base 102 attached via an intermediate body 104 to the second ring 90. The base 102 is in a plane generally parallel to a plane of the second ring 90 and is configured to support a vessel 19 thereon. The base 102 and intermediate body 104 are rigid such that they do not or only slightly bends under weight of the fluid filled vessel 19 and are preferably made of plastic or other suitable material. The intermediate body 104 may have a fixed length or be adjustable in length. It is noted that the embodiment illustrated by FIG. 7 is substantially the same as that of FIGS. 1-5, except for the configuration of the support structure.

Referring specifically to FIGS. 4 and 5, the shaft 96 of the first ring 88 includes a first portion 106 which externally extends from the first ring 88 and a second portion 108 pivotally attached to the first portion 106 via a pivot 110. The second portion 108 includes a channel 112 having a cut-out section 114. In use, the first portion 106 at least partially resides in the channel 112 and engages against the second portion 108 whereby the first portion 106 and second portion 108 are generally coaxially aligned to support the first ring 88 generally perpendicular to the longitudinal axis of the handle attachment 14. For storage of the device 10, the cut-out section 114 allows for the shaft first portion 106 to be rotated relative to the second portion 108 whereby a central axis of the first portion 106 is generally perpendicular to a central axis of the second portion 108. As such, the vessel holder 18 may be rotated thereby folding the device 10 into a smaller configuration for storage.

The shaft 96 may be fixedly attached to the handle attachment 14. Alternatively, the shaft 96 may be pivotally mounted to a stem 116 having an enlarged end 118 and extending from the handle attachment 14. As such, the handle attachment 14 may be rotated relative to the vessel holder 18 to allow the handle attachment 14 to optionally be attached to one of the suitcase extensible legs 30 while the second ring 90 remains generally horizontal.

In use, the device 10 is attached to a suitcase handle 12. Items are placed in the first and second pockets 48, 50 as desired. The vessel holder 18 is rotated outwards until the shaft 96 first and second portions 106, 108 are coaxially aligned and the first ring 88 is supported generally perpendicular to the handle attachment 14. A vessel 19 containing fluid or food is positioned in the support structure whereby the vessel 19 is being carried by the support structure. When the suitcase 12 is in an upright position, then the first and second rings 88, 90 are generally parallel and horizontal. When the suitcase is tilted at an angle, for example from 0 to 45 degrees, the first ring 88 while equally tilt by the same angle; however, the second ring 90 will rotate relative to the first ring 88 under the force of gravity in order to remain generally horizontal. As used herein, the term generally horizontal as it refers to the second ring 90 means that the second ring is within 15 degrees of being horizontal, more preferably within 10 degrees of being horizontal, and most preferred within 5 degrees of being horizontal when the suitcase is tilted at an angle of 30 degrees from the horizontal.

Figure 8:
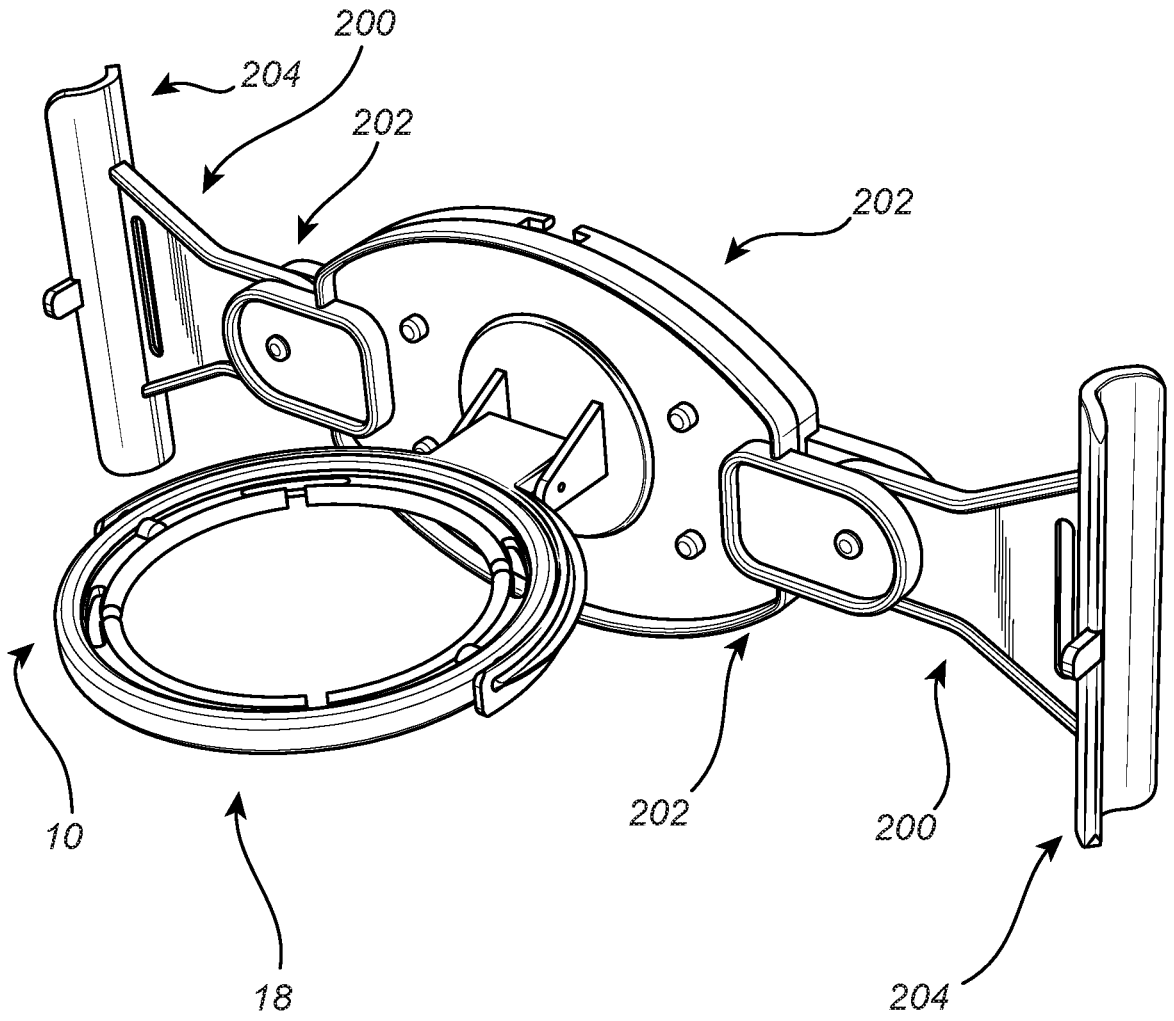
FIG. 8 is a perspective view of another exemplary embodiment of the vessel holder device of the present invention, utilizing a different type of handle attachment mechanism.

Referring specifically to FIG. 8, in another exemplary embodiment, the vessel holder device 10 again includes a body structure 20. In this exemplary embodiment, the body structure 20 is a substantially oval-shaped or rectangular molded plastic structure that is selectively disposed between the posts of the extensible handle of a suitcase or the like. It will be readily apparent to those or ordinary skill in the art that other shapes and/or materials may be used equally. As before, a pivoting and/or rotating gyroscoping vessel holder assembly 18 is coupled to one side of the body structure 20 such that it may be selectively deployed and used to hold a vessel, such as a cup or a bottle or the like, or folded up and stored substantially adjacent to the body structure 20. In this exemplary embodiment, a pivoting handle attachment structure 200 is coupled to each side of the body structure 20. Each pivoting handle attachment structure 200 includes a pivot arm 202 and a C-shaped cradle structure, split-cylinder clamp structure, or the like 204 that is configured to fixedly or removably secure the respective pivoting handle attachment structure 200 to the associated extensible handle post. It will be readily apparent to those of ordinary skill in the art that the pivoting handle attachment structures do not necessarily need to be pivoting and that they may be manufactured from any suitable material. One advantage to providing pivoting and/or telescoping functionality is that a variety of extensible handle shapes and sizes can be accommodated. Another advantage to providing pivoting and/or telescoping functionality is that the footprint of the vessel holder device 10 can be minimized for initial shipping and/or subsequent transport.

Referring specifically to FIG. 9, in a further exemplary embodiment, the vessel holder device 10 selectively retracts with the extensible handle 30 and is stowed in an enclosure 210 disposed within the interior of the suitcase 12. In order to facilitate this process, the vessel holder device 10 is first pivoted up (or down) such that is is substantially coplanar with the poles of the extensive handle 30. The extensible handle 30 then retracts (or extends) as normal, taking the vessel holder device 10 with it. The enclosure 210 may be one-piece or multi-piece and may be manufactured from any suitable material, such as a metal, a plastic, etc.

Regardless of the foregoing detailed description of exemplary embodiments of the invention, equivalent elements and relationships to those shown in the accompanying drawing figures and described in the written description are intended to be encompassed by the present invention, the foregoing being considered as illustrative only of the general concept and principles of the invention. Furthermore, since numerous modifications and changes will readily occur to those skilled in the art, the exemplary embodiments disclosed herein are not intended to limit the invention to the specific configuration, construction, materials and operation shown and described. Instead, all reasonably predictable and suitable equivalents and obvious modifications to the invention should be construed as falling within the scope of the invention as defined by the appended claims given their broadest reasonable interpretation in view of the accompanying written description and drawings.

What is claimed is:

1. A rolling case, comprising:
a case body;
an extensible handle;
a vessel holder device, comprising:
a body structure;
an attachment structure coupled to the body structure configured to couple the body structure to the extensible handle; and
a vessel holder assembly pivotably coupled to the body structure at a pivot joint; and
an enclosure disposed within an interior portion of the rolling case that is configured to receive the body structure, the attachment structure, and the vessel holder assembly with the vessel holder assembly pivoted with respect to the body structure at the pivot joint when the extensible handle is retracted towards and/or into the rolling case.

2. The rolling case of claim 1, wherein the attachment structure is pivotable with respect to the body structure.

3. The rolling case of claim 1, wherein the attachment structure comprises one or more cradles and clamps configured to couple the attachment structure to the extensible handle.

4. A vessel holder device for use with a rolling case comprising an extensible handle, the vessel holder device comprising:
a body structure;
an attachment structure coupled to each side of the body structure configured to couple the body structure to the extensible handle; and
a vessel holder assembly pivotably coupled to the body structure at a pivot joint;
wherein the body structure, the attachment structure, and the vessel holder assembly are adapted to be disposed within an enclosure disposed within an interior portion of the rolling case with the vessel holder assembly pivoted with respect to the body structure at the pivot joint when the extensible handle is retracted towards and/or into the rolling case.

5. The vessel holder device of claim 4, wherein each attachment structure is pivotable with respect to the body structure.

6. The vessel holder device of claim 4, wherein each attachment structure comprises one or more of a cradle and a clamp configured to couple the attachment structure to the extensible handle.

7. The vessel holder device of claim 4, further comprising the enclosure disposed with the interior portion of the rolling case that is configured to receive the body structure, the attachment structure, and the vessel holder assembly when the extensible handle is retracted towards and/or into the rolling case.

8. A vessel holder device for use with a rolling case comprising an extensible handle, the vessel holder device comprising:
a body structure;

an attachment structure coupled to the body structure configured to couple the body structure to the extensible handle;

a vessel holder assembly pivotably coupled to the body structure at a pivot joint; and an enclosure disposed within an interior portion of the rolling case that is configured to receive the body structure, the attachment structure, and the vessel holder assembly with the vessel holder assembly pivoted with respect to the body structure at the pivot joint when the extensible handle is retracted towards and/or into the rolling case.

9. The vessel holder device of claim 8, wherein the attachment structure is pivotable with respect to the body structure.

10. The vessel holder device of claim 8, wherein the attachment structure comprises one or more cradles and clamps configured to couple the attachment structure to the extensible handle.

* * * * *